United States Patent [19]

Jarmell et al.

[11] 4,306,859

[45] Dec. 22, 1981

[54] FURNACE PREHEATER

[75] Inventors: Solomon Jarmell, Pittsburgh; Barry E. Rodgers, Eastmont, both of Pa.

[73] Assignee: Fisher Scientific Company, Pittsburgh, Pa.

[21] Appl. No.: 155,663

[22] Filed: Jun. 2, 1980

[51] Int. Cl.[3] ..... F24H 1/00

[52] U.S. Cl. ..... 432/221; 34/224; 432/30; 432/226

[58] Field of Search ..... 432/29, 30, 221, 226; 34/223, 233; 219/269, 385, 399, 403

[56] References Cited

U.S. PATENT DOCUMENTS

| | | | |
|---|---|---|---|
| 2,343,345 | 3/1944 | Touton | 34/233 |
| 2,512,326 | 6/1950 | Harrison | 432/21 |
| 2,718,854 | 9/1955 | Michaelis | 432/120 |
| 3,581,679 | 6/1971 | Jansen et al. | 128/14 |
| 3,813,215 | 5/1974 | Ward | 432/226 |

*Primary Examiner*—John J. Camby

*Attorney, Agent, or Firm*—Webb, Burden, Robinson & Webb

[57] ABSTRACT

A preheater suitable for a laboratory furnace provides improved furnace temperature uniformity and atmosphere control. The preheater comprises a rectangular chamber which is adapted to be placed in the bottom of the furnace chamber. The preheater includes a pair of longitudinal passageways on opposite sides of the preheater chamber. There is a plurality of perforations in the top wall at one end of the preheater and along each passageway for distributing preheated air or other gas into the furnace chamber. In a preferred embodiment, the preheater is made of stainless steel, and the preheater chamber contains stainless steel wool which aids in heat transfer.

14 Claims, 6 Drawing Figures

FURNACE PREHEATER

BACKGROUND OF THE INVENTION

1. Field of the Invention

This invention relates to preheaters and particularly to an air or other gas preheater suitable for a laboratory furnace. The preheater according to the present invention provides improved furnace temperature uniformity and atmosphere control.

2. Brief Description of the Prior Art

Ashing of coal and coke samples in proximate analysis pursuant to procedures prescribed in ASTM D3172-73 (Reapproved 1979), D3174-73 (Reapproved 1979) and proposed revision for D3174-73 (subject to ballot at D.5.21.01 level as of Jan. 7, 1980) requires that air be introduced into a furnace chamber at the rate of 2 to 4 atmosphere changes per minute. Present methods for meeting this requirement are crude. One method is simply to open the furnace door about ½ inch, which allows air to diffuse into the furnace chamber. Another method employs a suction device for drawing ambient air directly into the furnace chamber. These methods are not completely effective, as pointed out in the text of the revision procedure. First, they destroy furnace temperature uniformity; at a nominal temperature of 750° C., the actual temperature may vary as much as ±100° C. Second, these methods produce so-called "shadow" zones in the furnace chamber. By "shadow" zones is meant areas which are simply devoid of air.

SUMMARY OF THE INVENTION

We have invented a preheater especially suitable for use in a laboratory furnace. The preheater comprises a rectangular chamber which is adapted to be placed in the bottom of the furnace chamber. The preheater includes a pair of longitudinal passageways on opposite sides of the preheater chamber. There is a plurality of perforations in the top wall at one end of the preheater and along each passageway for distributing preheated air or other gas into the furnace chamber. In a preferred embodiment, the preheater is made of stainless steel and the preheater chamber contains stainless steel wool which aids in heat transfer.

The preheater provides improved furnace temperature uniformity and atmosphere control. By using the preheater, "shadow" zones in the furnace are eliminated. Tests, such as ashing of coke or coal made in a furnace using the preheater, produce more accurate results and reduce analysis time.

DETAILED DESCRIPTION OF PREFERRED EMBODIMENTS OF THE INVENTION

Figure 1:
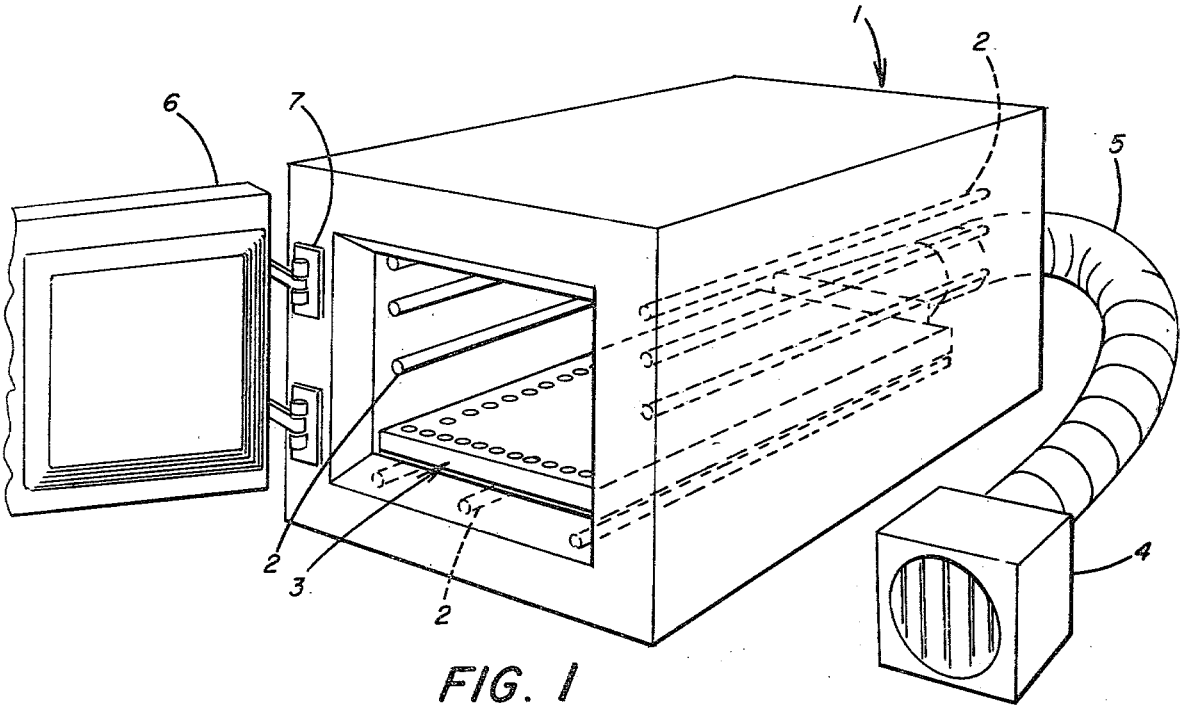
FIG. 1 is a perspective view of an electric laboratory furnace employing the preheater of the invention.
Figure 2:
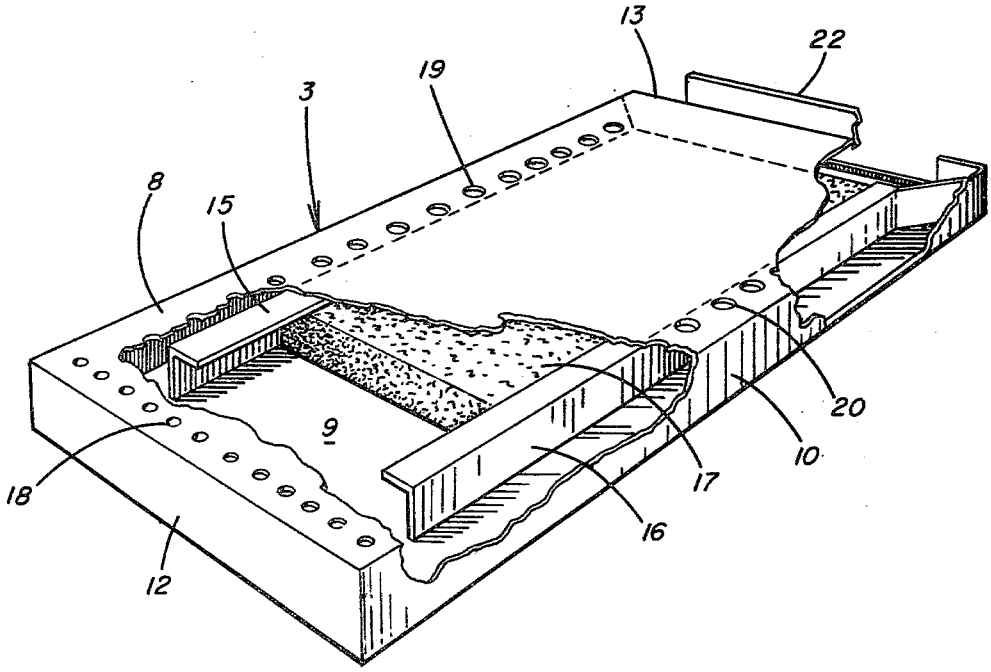
FIG. 2 is a perspective view, partially broken away, showing the preferred preheater structure.
Figure 3:
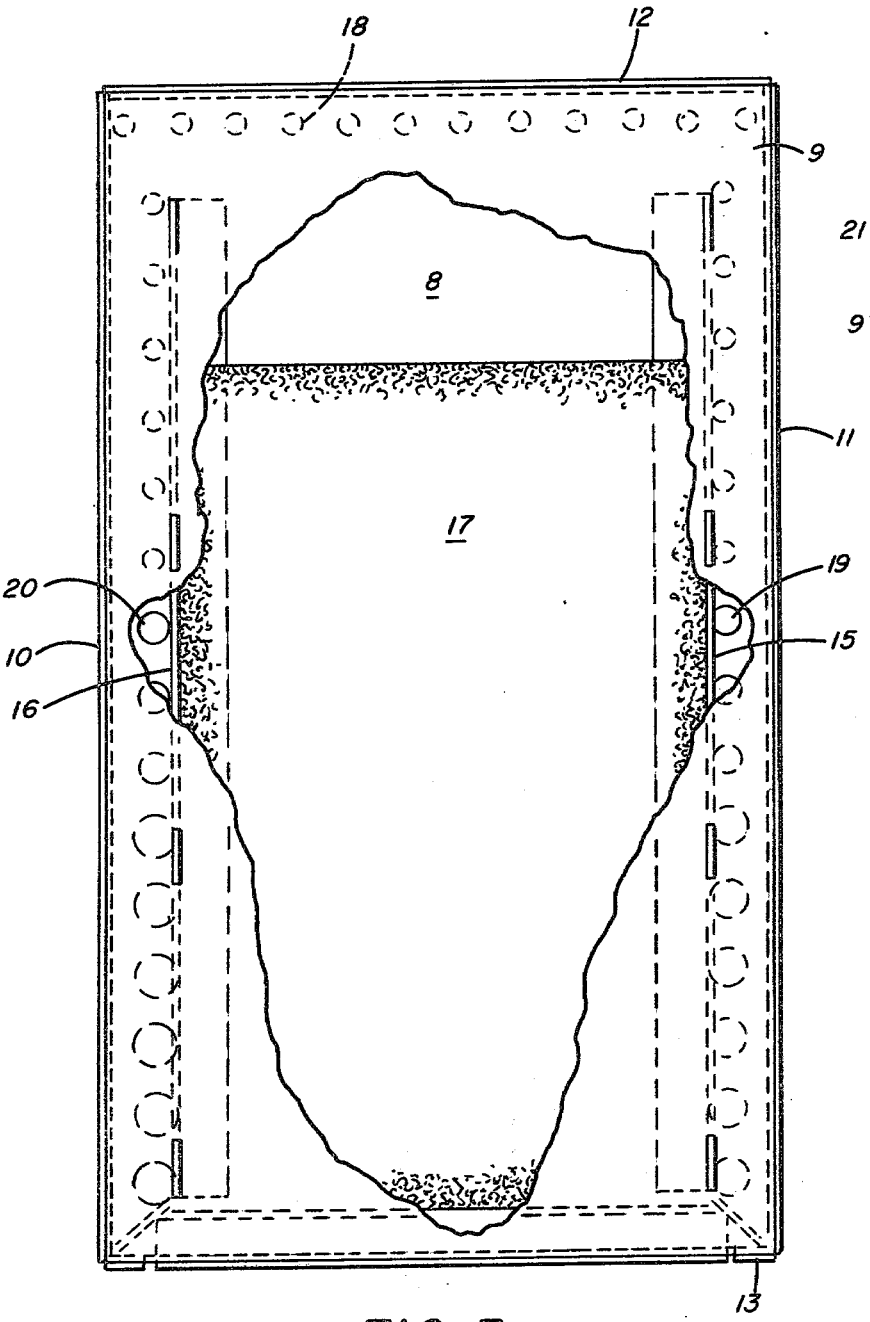
FIG. 3 is a bottom plan view of the preheater, partially broken away.
Figure 4:
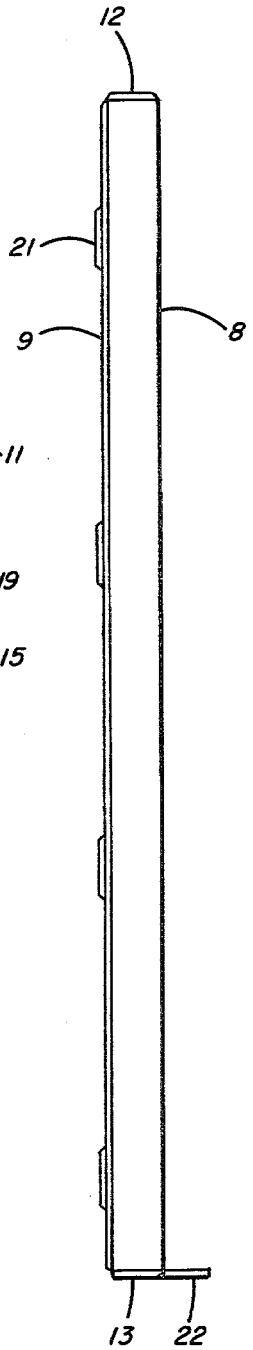
FIG. 4 is a side elevation view of the preheater.
Figure 5:
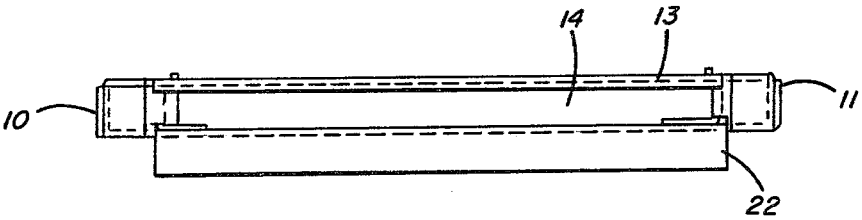
FIG. 5 is an end elevation view of the preheater looking into the open preheater chamber.

In one embodiment of the invention, a conventional laboratory electric furnace 1 having the usual electrical heating elements 2 on the sides and bottom of the furnace chamber is provided, as shown in FIG. 1, with an air preheater 3 in accordance with the invention. Means are provided, such as a fan 4, for forcing ambient air through a conduit 5 into the preheater through an opening in the rear wall of the furnace. The front opening of the furnace is adapted to be closed by a conventional door 6 with the usual hinges 7.

Referring to FIGS. 2–5, the preheater 3 comprises a relatively thin rectangular chamber formed by top wall 8, bottom wall 9, longitudinal sidewalls 10, 11 and end walls 12, 13. End wall 13 includes an opening 14 for admitting forced air into the chamber.

Two longitudinal ribs 15, 16, in the form of angles, are provided in the preheater. Each rib extends from its adjacent sidewall near end wall 13 to a point short of end wall 12, forming two longitudinal passageways along opposite sides of the preheater chamber. Thus, the end of the passageway adjacent wall 13 is closed. The walls and ribs are preferably made of thin stainless steel, for example, of 310SS, Inconel 600, Inconel 601 or 309SS of about 0.047" thick or 18 gauge.

The space defined by the ribs 15, 16 and the top and bottom walls preferably contains stainless steel wool 17 or similar heat conductive material. The steel wool with its large surface area facilitates the transfer of furnace heat to air in the preheater.

A plurality of perforations 18 is provided in the top wall 8 near end wall 12. Each of the perforations 18 has the same diameter. A series of perforations 19, 20 are also provided in the top wall 8 of the preheater in communication with each of the longitudinal passageways formed in part by the ribs 15, 16. The perforations in each series are of increasing diameter when viewed from end wall 12 toward end wall 13.

A number of rectangular welding beads 21 are provided on bottom wall 9. The beads result from welding tabs (not shown) on the ribs which are inserted through openings in the bottom plate and prevent distortion. An upstanding flange 22 is also provided on the end wall 13 adjacent the opening 14 to abut the rear wall of the furnace to act as a strengthener or stiffener to prevent bowing or distortion of the opening 14 when cold air rushes into the hot furnace chamber.

Figure 6:
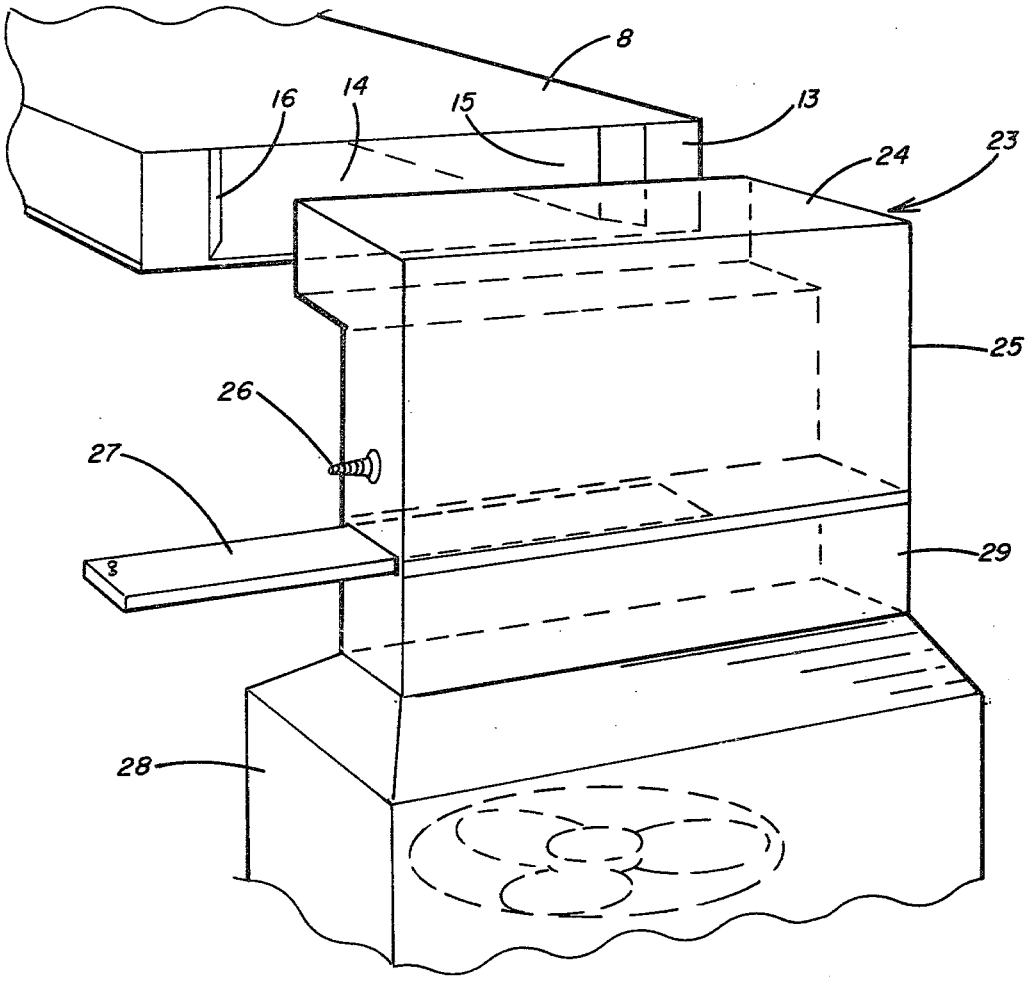
FIG. 6 is a partial perspective view of a duct assembly for introducing gas into the furnace through the preheater.

In a second embodiment of the invention, means are provided for introducing a gas, other than air, into the furnace chamber through the preheater. As shown in FIG. 6, a duct assembly includes an L-shaped duct member 23 having a leg 24 which is adapted to be inserted into opening 14 in the preheater. The leg 24 may be inserted into the opening until the end of the leg contacts the angled ribs 15 and 16 which serve as stop means.

The other leg 25 of the L-shaped duct member includes a fitting 26 to which a gas line from, for example, a standard pressurized gas cylinder (not shown) may be connected. The gas may be oxidizing or inert, an example of the latter being nitrogen.

A damper or slide 27 provided at the open end of the leg 25 is used to close off flow of air into the furnace chamber from a fan 28 through a necked-down duct 29 during the introduction of gas into the furnace. The duct assembly of FIG. 6 may be used in place of the conduit and fan shown in FIG. 1.

OPERATION

With the preheater 3 installed in a laboratory furnace as shown in FIG. 1, the furnace door 6 is closed tightly and the furnace chamber is heated by means of elements 2. Ambient air is forced into the preheater through opening 14 in end wall 13. The air passes between the ribs 15, 16 and into the steel wool 17 where it acquires heat. Part of the heated air leaves the preheater through perforations 18, and part of the air moves into one of the passageways and leaves through one of the perforations in the top wall 8 above the passageway. Since the perforations above the passageways increase in size as the air passes along a passageway, the least amount of air is distributed through the smaller perforations and greater amounts of air are distributed through the larger perforations as the air passes along the passageways. In this manner, a relatively constant supply of preheated air is uniformly distributed to the chamber and "shadow" spots are eliminated. Since the air is preheated before reaching the furnace chamber, large temperature gradients are avoided.

When the duct assembly of FIG. 6 is employed with the preheater, gas, other than air, may also be forced into the furnace chamber under pressure. With this modification, the damper is closed to prevent the air from entering the duct and gas under pressure is forced into the preheater. In this manner, air can be excluded entirely from the furnace during an analysis.

Having described presently preferred embodiments of the invention, it is to be understood that it may be otherwise embodied within the scope of the appended claims.

We claim:

1. A preheater for a furnace chamber comprising:

A. a rectangular chamber defined by two sidewalls, two end walls, a top wall and a bottom wall, one end wall having an opening for admitting air or gas to the preheater;

B. a pair of passageways extending between the top and bottom walls along opposite sides of the preheater chamber, each of said passageways being closed at an end adjacent said opening; and C. a plurality of perforations in the top wall of the preheater at an end opposite said opening and along each passageway for distributing preheated air or other gas into the furnace chamber.

2. The preheater as set forth in claim 1 wherein the passageways are formed by a pair of ribs extending substantially parallel to but spaced from the sidewalls along the length thereof and partially through the preheater chamber between the top and bottom walls thereof.

3. The preheater as set forth in claim 1 or claim 2 and including stainless steel wool disposed in the preheater chamber between the passageways.

4. The preheater as set forth in claim 3 wherein said walls are made of stainless steel.

5. The preheater as set forth in claim 1 wherein the perforations are holes and the diameter of the holes in the top wall along each passageway increases from the end opposite the air or gas admitting opening in the end wall to the end of the preheater adjacent the opening.

6. The preheater as set forth in claim 1 wherein said walls are made of stainless steel.

7. In a laboratory furnace, a preheater for heating air or other gas forced into the furnace chamber, said preheater comprising:

A. a rectangular chamber defined by two sidewalls, two end walls, a top wall and a bottom wall, one end wall having an opening for admitting forced air or gas to the preheater;

B. a pair of passageways formed by a pair of ribs extending substantially parallel to but spaced from the sidewalls along the length thereof and partially through the chamber between the top and bottom walls thereof along opposite sides of the preheater chamber, each of said passageways being closed at an end adjacent said opening; and C. a plurality of perforations in the top wall of the preheater at an end opposite said opening and along each passageway for distributing preheated air or gas into the furnace chamber.

8. The preheater as set forth in claim 7 wherein stainless steel wool is provided in the preheater chamber between top and bottom walls and the ribs.

9. The preheater as set forth in claim 7 or claim 8 wherein the size of the perforations in the top wall along each passageway increases from the end opposite the air or gas admitting opening in the end wall to the end of the preheater adjacent the opening.

10. The preheater as set forth in claim 9 wherein the walls are made of stainless steel.

11. The preheater as set forth in claim 7 and including a duct assembly for guiding air or gas into the preheater, said assembly including a duct member adapted to communicate on one end with the opening in said preheater and on the opposite end with a fan for forcing air or gas into the preheater.

12. The preheater as set forth in claim 11 wherein said duct member includes means for closing off communication between said member and said fan.

13. The preheater as set forth in claim 12 wherein said duct member includes means for introducing gas other than air into said duct member.

14. The preheater as set forth in claim 12 wherein said closing means comprises a damper.

* * * * *